US005924609A

United States Patent [19]

Stolk et al.

[11] Patent Number: 5,924,609

[45] **Date of Patent: *Jul. 20, 1999**

[54] METHOD AND MEANS FOR TAKING OFF AN ELASTIC COVER FOR LIMBS

[75] Inventors: Robert Stolk, Tuitjenhorn; Carolina Maria Wester, Zaandam, both of Netherlands

[73] Assignee: N.V. Varitex, Netherlands

[ * ] Notice: This patent issued on a continued prosecution application filed under 37 CFR 1.53(d), and is subject to the twenty year patent term provisions of 35 U.S.C. 154(a)(2).

[21] Appl. No.: 08/652,564

[22] PCT Filed: Aug. 18, 1995

[86] PCT No.: PCT/NL95/00276

§ 371 Date: Jun. 11, 1996

§ 102(e) Date: Jun. 11, 1996

[87] PCT Pub. No.: WO96/11618

PCT Pub. Date: Apr. 25, 1996

[30] Foreign Application Priority Data

Oct. 13, 1994 [NL] Netherlands ..... 9401688

[51] Int. Cl.[6] ..... A47G 25/90

[52] U.S. Cl. ..... 223/112; 223/111

[58] Field of Search ..... 223/111, 112, 223/118

[56] References Cited

U.S. PATENT DOCUMENTS

| | | | |
|---|---|---|---|
| 4,153,054 | 5/1979 | Boone | 223/111 |
| 5,356,057 | 10/1994 | Vossen | 223/112 |
| 5,601,220 | 2/1997 | Vossen | 223/112 |

FOREIGN PATENT DOCUMENTS

| | | | |
|---|---|---|---|
| 788477 | 10/1935 | France . | |
| G9309511 | 10/1993 | Germany . | |
| 4312603 | 10/1994 | Germany | 223/111 |
| 9000361 | 9/1991 | Netherlands | 223/112 |
| 447539 | 11/1986 | Sweden . | |
| 850165 | 12/1955 | United Kingdom . | |

*Primary Examiner*—Bibhu Mohanty

[57] ABSTRACT

A method of taking off an elastic cover (3) for limbs is characterized by applying a wrapping (1) of smooth material around the elastic cover (3) and then stripping the cover (3) from above with interposition of the smooth wrapping (1) between the stripped away portion (3') and the portion (3") still in position on the limb. A take off means for use in this method is characterized by a wrapping (1) of smooth material fitting around the cover (3) on the leg or arm.

7 Claims, 2 Drawing Sheets

METHOD AND MEANS FOR TAKING OFF AN ELASTIC COVER FOR LIMBS

FIELD OF THE INVENTION

The present invention relates to a method of taking off an elastic cover for limbs, as well as take off means which can be used therein.

BACKGROUND OF THE INVENTION

In the field of elastic therapeutic stockings, a large number of means are developed through the years in order to facilitate putting on these stockings. These developments are shown in a series of Patent Applications, i.e. DE-C-478 051, FR-A-788.477, SE-B-447 539, SE-B-455 566 and WO-A-91/05498. The first document dates back to 1928, while the last is from 1991. This shows that the problem of putting on elastic therapeutic stockings is a long existing one and solutions are still being developed.

In practise it appears, however, that not only the operation of putting on elastic therapeutic stockings, but also taking them off involve difficulties and is maybe even a bigger problem then putting on these stockings. Particularly older people do not have the power to take off the cover and in particular the elastic therapeutic stocking.

SUMMARY OF THE INVENTION

The object of the present invention is to provide a method of taking off an elastic cover in which the problem described is removed or reduced in a surprisingly simple manner.

For this purpose, the method according to the invention is characterised by applying a wrapping of smooth material around the elastic cover and then stripping the cover from above with interposition of the smooth wrapping between the stripped away portion and the portion still in position on the limb.

By these simple measurements the required force for stripping off the elastic cover is reduced substantially because the frictional force between the stripped off portion of the cover and the portion still in position is reduced by the smooth wrapping that will also be stripped and thereby slides against itself with very low friction.

It is noted that a wrapping of smooth material is well known in the art for a long time, as shown by the documents mentioned above with respect to means for putting on, but nobody has thought of using such wrapping for taking off elastic therapeutic stockings and the like notwithstanding the long existing problem in taking off these stockings. The present inventors have therefore got out of a routine and these solution of the invention is hence not obvious.

Although the method according to the invention is suited for taking off both covers for the arm and covers for the leg, particularly the latter is an even bigger problem resulting from the presence of the heel-instep area which has a substantially larger circumference than the overlying leg part and therefore additional power is needed to pull the tight portion of the elastic stocking over this heel-instep area. In this application it is favourable to use a tapering wrapping which is put on to such an extent that it is positioned tightly against the heel and instep. This ensures that the wrapping remains stationary in this area and that the overlying portion of the wrapping slides by when the stocking is stripped off. The tapering of the wrapping also enables the use of a single wrapping size for a variety of foot and hand sizes also with inelastic wrappings. With the cover for the arm, the hand causes problems during the take off operation since the circumference thereof is larger than that of the wrist.

The invention also includes the take off means for use in the method described above.

BRIEF DESCRIPTION OF THE DRAWINGS

The invention will be further illustrated with reference to the drawing showing an embodiment of the invention by way of example.

DETAILED DESCRIPTION OF THE PREFERRED EMBODIMENT

Figure 1:
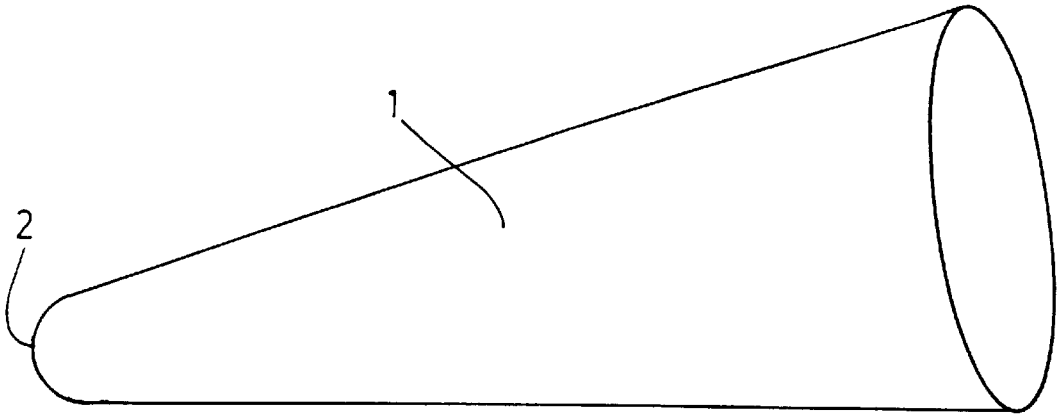
FIG. 1 is a view of an exemplary embodiment of the take off means according to the invention.

FIG. 1 schematically shows the take off means according to the invention in its configuration of a wrapping 1 which is formed of a thin, supple and smooth material having a very low coefficient of friction in relation to itself. As an example thereof a nylon-fabric having a teflon-coating can be mentioned. The wrapping 1 is tapered in this case and is closed on the end 2 which is intended for the toe of the foot. Particularly in the tapering embodiment, the wrapping 1 may also be opened on both ends. Preferably only one or two sizes of wrappings are used, whereby the tapering ensures that the wrapping 1 can be put around both thick and slim feet. The circumference of the heel-instep area of the foot will determine the extent to which the wrapping 1 can be put on. The extent to which the wrapping 1 can be positioned around the foot and leg is not important as long as a portion of the wrapping 1 extends beyond the heel-instep area. In practice, the circumference of the heel-instep area varies between 29 and 40 cm so that the tapering should cover this range largely in case of a universal take off means.

Figure 2:
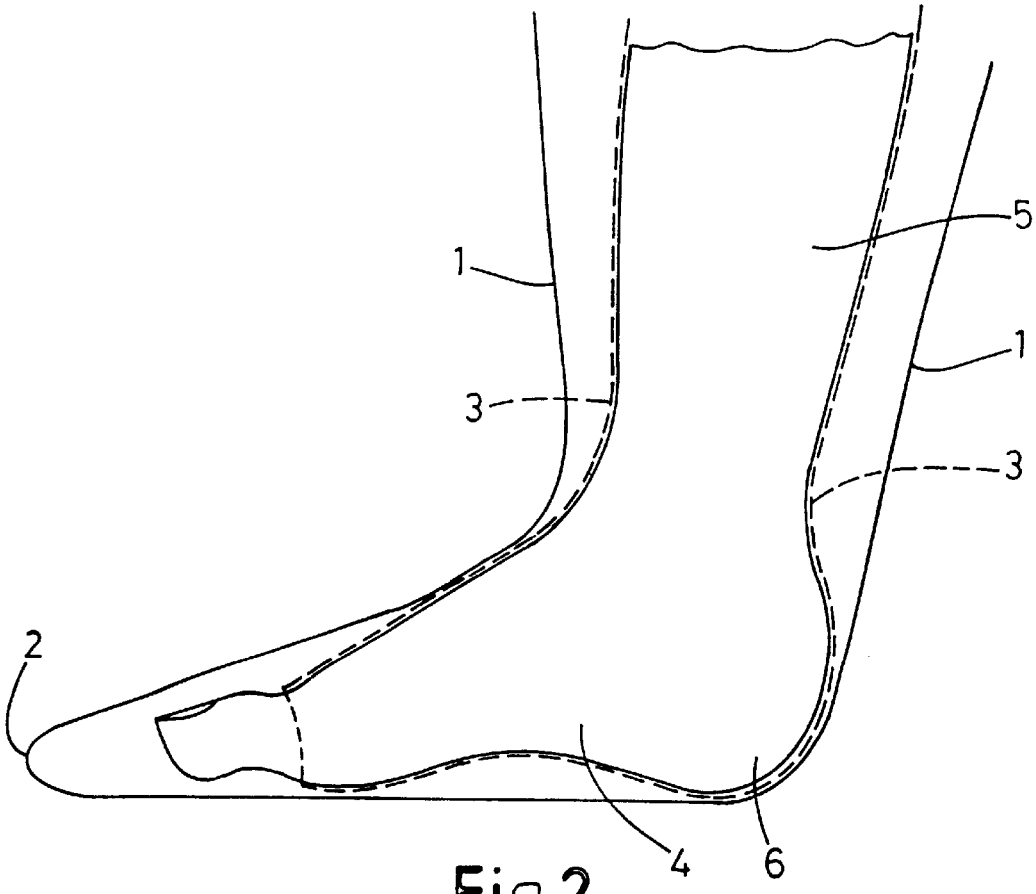
FIGS. 2–4 illustrate in side view three stages of the method of taking off a therapeutic elastic stocking.
Figure 4:
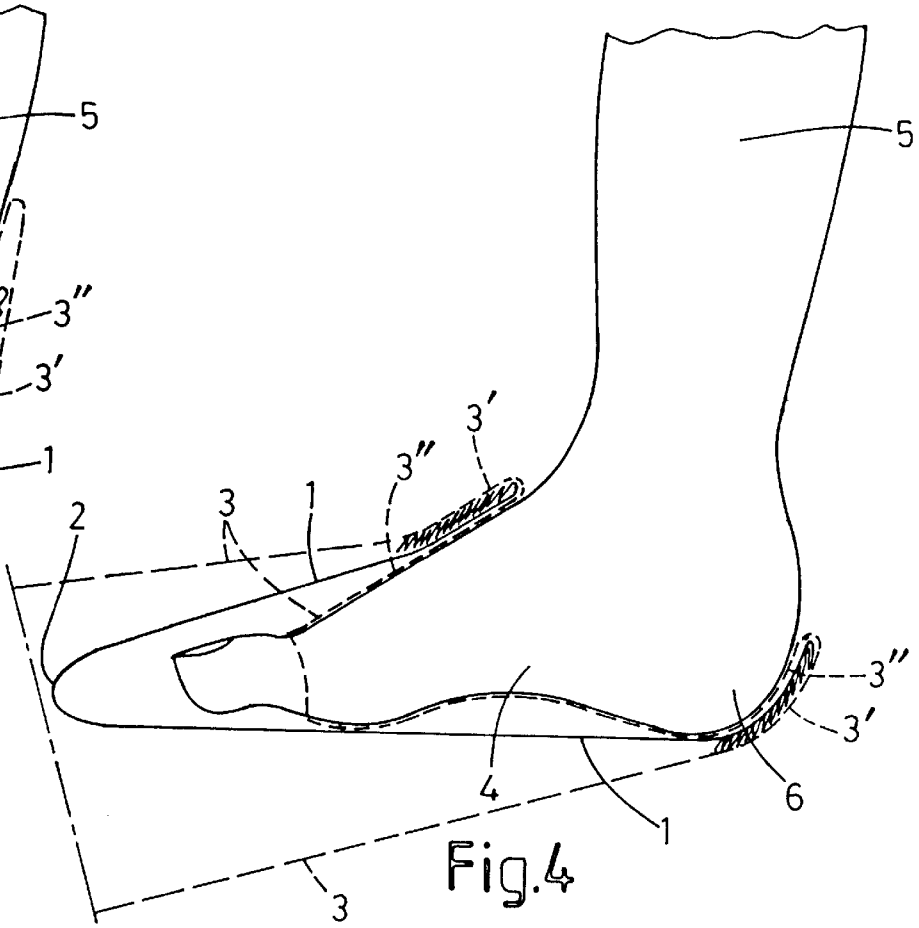
Figure 3:
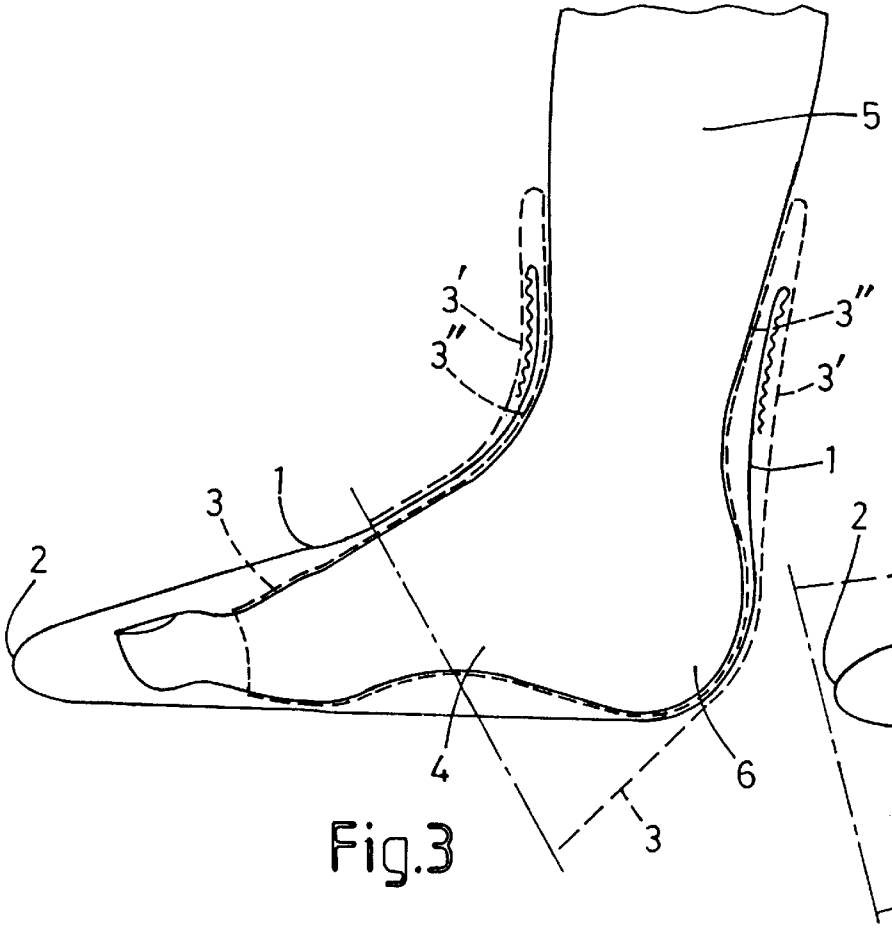

FIGS. 2–4 illustrate the method of taking off an elastic stocking 3 which is shown in its position in use around the foot 4 and the overlying part of the leg 5. In this case, the elastic stocking is shown having a open toe, but the invention is also suited for stockings having a closed toe and for all other types of elastic stockings.

FIG. 2 shows the start of the method in which the wrapping 1 is applied around the foot 4 and the leg 5 and over the stocking 3 until the wrapping 1 is tightly clamped against the heel-instep area 6 of the foot 4. The overlying portion of the wrapping 1 will broadly surround the leg 5 but this does not affect the method.

FIG. 3 shows that the elastic stocking 3 is stripped off downwardly from the upper end wherein the upper portion of the stocking 3 is pulled over the heel-instep area 6 relatively easily because the upper end of the elastic stocking is relatively wide. The problems start particularly then when the portion of the elastic stocking 3 intended for the area above the ankle of the foot 4 should be pulled over the heel-instep area 6. It is shown in FIG. 3 that when the elastic stocking 3 is stripped off downwardly, the upper portion of the wrapping 1 is squeezed between the stripped off portion 3' of the elastic stocking 3 and the portion 3" of the stocking 3 which is still in position on the leg, and is therewith also folded back so that a double layer of the smooth material of the wrapping 1 is formed. The tightly positioned portion of the wrapping 1 in the heel-instep area 6 works as a kind of trap ensuring that the lower portion of the wrapping 1 remains in position and the upper portion of the wrapping 1 being forced to being stripped off downwardly along itself. Due to the formed double layer of smooth material of the wrapping 1 both layers of the wrapping 1 slide alongside with little frictional force.

FIG. 4 shows the stage of taking off the elastic stocking 3 in which the most narrow portion of the elastic stocking 3 is pulled over the heel-instep area 6. The stocking 3 and the wrapping 1 are then stripped off simultaneously so that both between the stocking 3 and the heel-instep area 6 and between the stocking 3 and the wrapping 1 there is hardly a sliding movement and the only sliding movement is caused between both layers of the wrapping 1. Due to the very low coefficient friction of the material of the wrapping 1 with itself, the frictional force during taking off of the stocking 1 by means of the wrapping 3 will be substantially reduced, said frictional force would have caused the major part of the total take off force without the wrapping 1. The take off operation with the wrapping 1 in fact requires almost only the force which is necessary to stretch the narrow portion of the elastic stocking 3 up to the circumferential size of the heel-instep area 6.

Tests have shown that, depending on material and elastic pressure, the maximum take off force during the take off operation of the elastic therapeutic stocking 3 with the use of the take off means described above in its embodiment of the wrapping 1 is decreased by 30–50% in relation to the force during the take off without any means. For example, instead of a take off force of 12 kg, a take off force of only 7.5 kg is required. This facilitates the take off operation substantially and enables elderly people to take off their therapeutic stockings themselves. Further, the use of the take off means is very simple and does not require complicated manipulation.

The invention is not restricted to the embodiment shown in the drawing and described herein before which may be varied in different manners within the slope of the invention. For example, the take off means could also be circumferentially elastic in at least part of its length in order to be used for different thicknesses of feet and legs. In case of an inelastic material of the wrapping, elastic inserts could be used possibly covered by flaps of the smooth material in order to form a smooth surface the whole length and circumference of the wrapping 1.

We claim:

1. A method of removing an elastic therapeutic cover from a human limb comprising:

providing a wrapping having inner and outer surfaces, the outer surface being sufficiently smooth so that it can slide against itself with low friction, placing the wrapping around the elastic cover, the cover having opposed ends, everting one end of the cover and stripping the everted end toward the other end of the cover to cause the wrapping to become everted within the everted cover to a double layer such that the outer surface of the wrapping slides against itself as the everted portion of the cover and the wrapping is advanced.

2. Method according to claim 1 for taking off an elastic therapeutic stocking from a leg and foot, in which a tapered wrapping is used which is pulled on to such extent that it is tightly positioned against the heel and instep of the foot.

3. A device for removing an elastic therapeutic cover from a human limb comprising:

a generally tubular wrapping of thin flexible material having an opening at one end adapted and sized to receive the limb and cover, and being evertable with the cover;

the material being defined by an inner surface and an externally exposed outer surface on opposite sides of the material, the material comprising a fabric or composite coated, at least on the outer surface, with a material having low-friction properties;

the inner surface being engageable with the cover and the outer surface being sufficiently smooth so that, when everted with the cover, it can slide against itself with low friction wherein, when placed on a foot to remove an elastic cover, the wrapping covers at least a portion of the foot and leg, extending beyond the heel and instep area of the foot, and surrounds at least a portion of the leg.

4. A device according to claim 3, wherein the wrapping has a tapering configuration.

5. A device according to claim 3 or 4, wherein the wrapping is closed on one end.

6. A device according to claim 3, wherein the material of the wrapping is inelastic.

7. A device according to claim 3, wherein the wrapping is circumferentially elastic at least in part lengthwise.

* * * * *